United States Patent [19]

Müller

[11] Patent Number: 4,560,063

[45] Date of Patent: Dec. 24, 1985

[54] PAPER CONTAINER FOR HOT LIQUIDS AND METHOD AND APPARATUS FOR MAKING SAME

[75] Inventor: Berthold Müller, Süssen, Fed. Rep. of Germany

[73] Assignee: Michael Horauf Maschinenfabrik GmbH & Co. KG, Sussen, Fed. Rep. of Germany

[21] Appl. No.: 613,037

[22] Filed: May 22, 1984

[30] Foreign Application Priority Data

Jun. 25, 1983 [DE] Fed. Rep. of Germany ..... 3322977

[51] Int. Cl.[4] ..... B65D 3/10

[52] U.S. Cl. ..... 229/5.5; 229/5.7; 220/66

[58] Field of Search ..... 229/5.7, 5.5; 220/66

[56] References Cited

U.S. PATENT DOCUMENTS

| | | | |
|---|---|---|---|
| 2,190,990 | 2/1940 | Link | 229/5.7 |
| 4,008,846 | 2/1977 | Gordon | 229/5.7 |
| 4,098,404 | 7/1978 | Markert | 220/66 |
| 4,120,419 | 10/1978 | Saunders | 220/66 |
| 4,147,271 | 4/1979 | Yamaguchi | 220/66 |
| 4,266,685 | 5/1981 | Lee, Jr. | 220/66 |
| 4,341,321 | 7/1982 | Gombas | 220/66 |
| 4,431,112 | 2/1984 | Yamaguchi | 220/66 |

*Primary Examiner*—Joseph Man-Fu Moy

*Attorney, Agent, or Firm*—Burns, Doane, Swecker & Mathis

[57] ABSTRACT

A paper container has a bottom in which there is impressed a deformation groove to allow the bottom to deform in response to reduced internal pressures occurring as a hot liquid cools inside of the closed container. The bottom is formed in a continuous one-step process in which a series of coaxially arranged, telescoping tools travel relative to one another along a common axis to form the bottom with the deformation groove and a bent outer edge.

3 Claims, 7 Drawing Figures

FIG.1
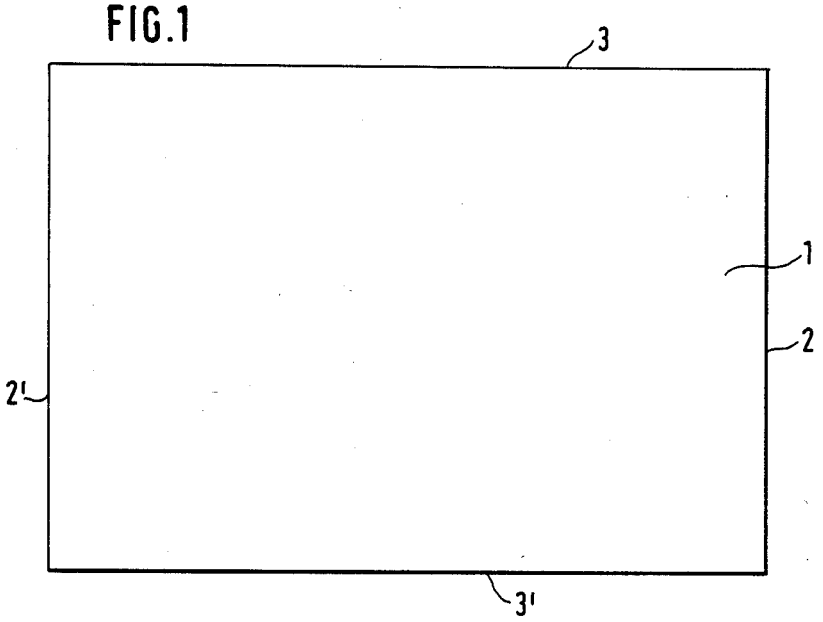
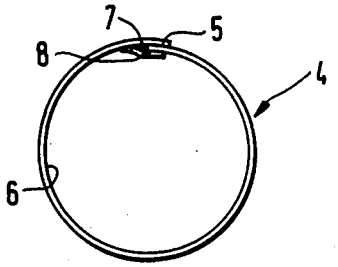
FIG. 2
FIG. 3
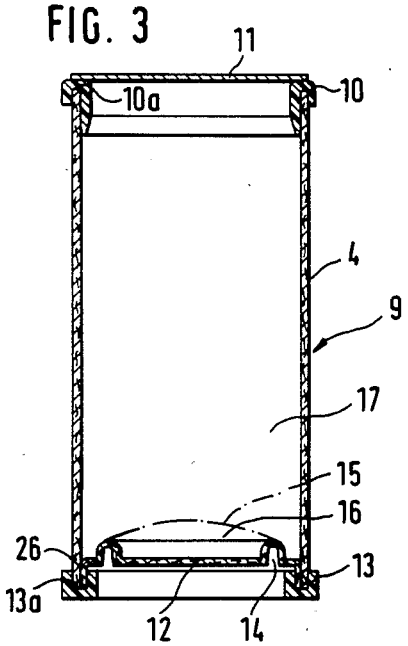

14
12
29
28
30
21
26
20
40
A
B
C
18a
27
33
23
22
31
25
24
19
18

PAPER CONTAINER FOR HOT LIQUIDS AND METHOD AND APPARATUS FOR MAKING SAME

BACKGROUND AND OBJECTS OF THE INVENTION

The invention concerns a paper container for hot liquids. In particular, the container is of the type which comprises a wound jacket, a bottom set into the jacket and preferably recessed from the bottom edge of the container, together with a support surface for a tight cover, and deformation areas which permit a controlled reduction in container volume during the cooling of the liquid contained therein.

Paper containers to be filled with liquids generally are provided at least on the inside with a liquid-tight coating. In view of the winding process, the outer form is, in general, cylindrical or slightly conical. From EP-OS No. 68 334 a paper container of the aforedescribed type is known. Into such containers, liquids such as fruit juices or coffee, for example, are usually filled in a hot state. Hot filling is intended to preserve the contents without the use of chemicals.

Following the filling and sealing of such paper containers, reduced pressure is generated within the container during the cooling of the contents, which leads to an unattractive deformation of the container jacket. To remedy this situation, the paper container according to EP-OS No. 68 334 is provided along the generating lines of the jacket with linear creases, whereby the jacket is given a polygonal configuration in the center area. During the filling of a hot liquid, pressure rolls are applied to the polygonal surfaces, which subsequently are deformed during the cooling process in a controlled and uniform manner. A container is produced, the jacket thereof being cylindrical in the upper and lower area and polygonal in the center. It is a disadvantage that not only is an increased manufacturing effort necessary for the jacket itself, but that during the filling of th paper container, additional tools must be applied to the jacket.

It is an object of the invention to enable a novel paper container to be made in which the reduced pressure generated inside the container upon the cooling of the hot liquid will not lead to deformations that would alter or detrimentally affect the exposed outside of the container.

SUMMARY OF THE INVENTION

The invention involves the provision of deformation areas on the container bottom. As the full container usually stands on its bottom, the areas which yield upon the reduction in volume remain unexposed to the outside so that the paper container retains its intended conventional appearance. No processing measures to be applied to the wound jacket are required. The effort expended in the forming of the bottom is comparatively slight. Finally, it is no longer necessary to operate special tools or structural parts in the filling station.

In order to obtain the effect according to the invention, the bottom may have a significantly lesser wall thickness than the jacket. This results in the fact that the bottom as an area of intentional deformation offers substantially less resistance to the reduced pressure than the jacket. Preferably, the wall thickness of the bottom amounts to approximately one-third of that of the jacket. Furthermore, the bottom may comprise several layers in a sequence from the inside out, for example, four layers, i.e., polyethylene, aluminum, paper and again polyethylene.

Appropriately, the fact that the reduction in volume of the container amounts to approximately 3 to 6 percent of the nominal volume of the container is taken into account in the layout of the bottom and the intentional deformation areas. This order of magnitude corresponds to the change in volume of the substance filled in and the change in pressure in the space between the content and the cover.

Advantageously, the bottom may be provided in its deformation area with an impression, for example in the form of a circular groove outlining the deformation area, which groove is preferably impressed from the outside into the bottom. Depending on the wall thickness of the container or its dimensions, several such grooves may be provided, which preferably are arranged in the vicinity of the area wherein the bottom is beaded for the purpose of its insertion into the container jacket. The circumferential groove forms the area around which the bottom is deformed upon the equalization of the pressure reduction. In this manner, the other areas of the bottom are exposed to no appreciable deformation during the inward bulging process. In the case of a circular groove, the bottom bulges inwardly into the shape of a semi-spherical cap, such as is known from the bottoms of metal cans or the like, under pressure, whereby an attractive appearance of the paper container is thus preserved even after the reduction in volume.

The invention further comprises an apparatus and method for the production of a paper container of the aforedescribed type with an indentable bottom, preferably equipped with a circular groove impressed from the outside. The novel apparatus is characterized in that all of the partial tools required for the production of the beaded edge and the pressing of the bottom are designed in the form of partial tools located coaxially within each other, actuated by means of a common, axial forward motion. The three separate work processes for the production of the bottom may thus be effected in a single process step, successively.

BRIEF DESCRIPTION OF THE DRAWINGS

The invention is represented in the drawings with the aid of examples of embodiment for the novel paper container and for an apparatus for the production of the bottom of such paper containers and is further explained hereinbelow. In the drawings:

FIG. 1 shows a blank for a container jacket;

FIG. 2 depicts the wound container jacket in a top view;

FIG. 3 depicts a paper container according to the invention; and

DETAILED DESCRIPTION OF A PREFERRED EMBODIMENT OF THE INVENTION

Figures 4A, 4B, 4C, 4D:
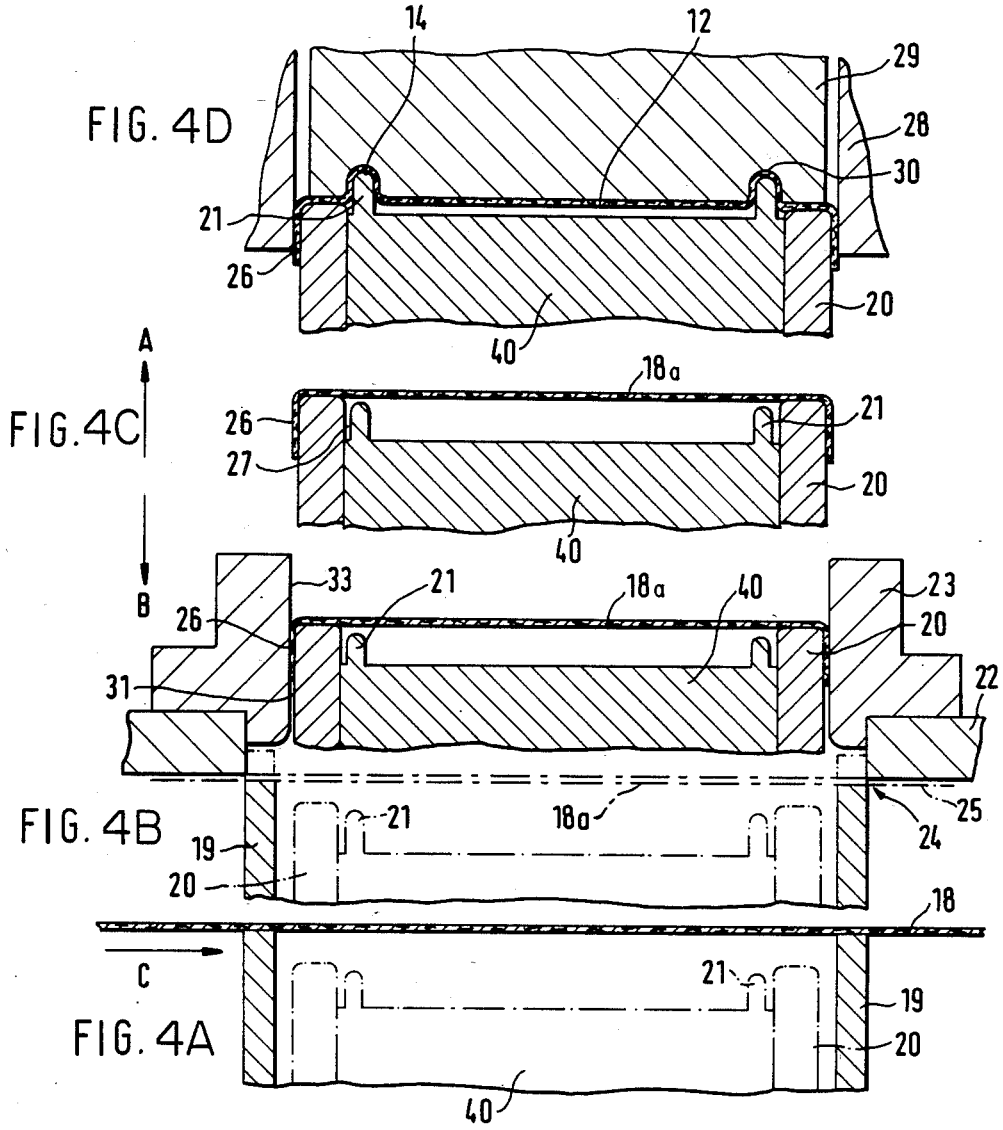
FIGS. 4A–4D depict an apparatus for the production of the container bottom, the sequence of operation beginning with FIG. 4A and progressing toward FIG. 4D.

A blank of FIG. 1 has a rectangular configuration, if the paper container to be manufactured is to have a cylindrical shape. In a production of a conical paper container it would be necessary to alter the blank appropriately in its dimensions. The sides 3 and 3' of the blank are forming the latter with upper and lower cut edges of the container jacket 4 to be wound (see also FIG. 2). The sides 2 and 2' of the blank 1 become overlapped at 5 in the wound jacket. At least the internal surface of the blank 1 is protected by a coating or the like, as indicated by 6 in FIG. 2. At least the inner open cut edge 7 of the wound container jacket 4 is covered by a strip 8, which may consist of a thin, liquid-tight foil, adhesively bonded along the entire juncture line of the jacket. Alternatively, the sealing strip 8 may be sealed together with the container jacket 4, for which purpose it is preferable that the liquid-tight surface coating should also be sealable.

The finished paper container 9 according to FIG. 3 thus has a cylindrical jacket 4, the upper open cut edge 3 (FIG. 1) of which is covered by a synthetic plastic ring 10, provided with a corresponding groove 10*a* for its insertion on the container jacket 4. The plastic ring 10 has an upper support surface, to which a cover 11, preferably a removable aluminum foil, is applied following the filling of the paper container 9. The ring 10 is placed onto the jacket 4 so that the paper container 9 is always sealed in an air-tight manner.

Into the jacket 4 is inserted a container bottom 12 which is recessed inwardly with respect to the lower edge of the container. The bottom 12 is equipped for that purpose with a circumferential beaded edge 26. The open lower cut edges of the container 4 and the container bottom 12 are covered with a synthetic plastic ring 13, which for its insertion has a corresponding circular groove 13*a*.

The bottom 12 may comprise an inner layer of polyethylene, followed by layers of aluminum, paper and polyethylene.

Both synthetic plastic rings 10 and 12 are subsequently sealed together with the container jacket 4 and optionally also with the beaded edge 26 of the container 12.

When a hot liquid is poured into the container 9, the temperature of which liquid being higher than the ambient temperature, and when subsequently the container 9 is sealed with the cover 11, a reduced pressure is thereafter generated inside the container 9 during the cooling of the liquid. That would normally lead to a deformation in particular of the container jacket 4, if no special measures are taken. Particularly in the case of cylindrical paper containers 9 these deformations result in an unattractive appearance and for this reason the use of such purely cylindrical containers for hot filled contents has been avoided in the past.

To solve the problem in accordance with the present invention, a circumferential groove 14 is impressed into the bottom 12 from the outside, which makes it possible for the container bottom 12 to bulge inwardly, when the cooling of the liquid generates a reduction in pressure inside the paper container 9. The inwardly bulging contour 15 of the container bottom 12 is shown in FIG. 3 by a dash-and-dot line. It is seen that the volume 17 of the paper container 9 is reduced by an amount designated by 16, which represents approximately 3 to 6 percent of the nominal volume 17 of the paper container 9. To facilitate the inward bulging of the bottom 12, the wall thickness of the latter preferably amounts to one-third of the thickness of the container jacket 4. The greatest deformation takes place in the area of the circumferential groove 14.

FIGS. 4A–4D show schematically the operative steps of an apparatus for the production of the grooved container bottom 12, wherein the individual process steps take place in steps from the FIG. 4A to FIG. 4D during a single axial movement of the tool in the direction of the arrow A. The arrow B indicates the direction of the return of the tool. The tool comprises several partial tools located coaxially within each other; their configuration and function will become apparent from the production process of a container bottom 12 described below.

In keeping with the direction of transport C initially an endless section 18 from which the container bottom is to be prepared, is brought into position (FIG. 4A). The section 18 travels after processing in the direction of the arrow C, so that the next bottom may be prepared. The section 18 at first comes to rest on a hollow, cylindrical die 19, which is movable in the working direction A. Inside the hollow, cylindrical die 19 additional partial tools 20 and 40 are indicated by dash-and-dot lines. Those tools are displaceable both with respect to each other and to the die 19, in the longitudinal direction A, as explained further hereinbelow. Initially, however, the partial tools 20 and 40 are not in operation.

The hollow cylindrical die 19 is now moved into a second position (FIG. 4B) by any suitable means such as a fluid-actuated motor, whereby the partial tools, indicated by dash-and-dot lines (and still inoperative), are also moved into a second position. The hollow cylindrical die in its second position is cooperating with a counter holding ring 22 and functions together with such ring as a stamping tool. Along a circular line, which in FIG. 4 is indicated in one corner 24 only, a circular area 18*a* is stamped from the strip section 18. The residues 25 indicated by a dash-and-dot line are not used further for the preparation of the container bottom 12. During the stamping step the hollow, cylindrical die 19 may be moved further in the upward direction past the second position shown to a very small extent to a third position, as indicated by the broken lines in FIG. 4B.

The counter holding ring 22 is resting in a holder 23, a cylindrical inner wall 33 whereof is operative during a subsequent drawing process (FIG. 4B) to produce the beaded border 26 of the container bottom 12. For this purpose, the partial tool 20 serves as a drawing tool and has a sleeve-like configuration. The drawing tool is moved in direction A relative to the die 19 to a drawing position (see the solid lines of FIG. 4B) wherein it cooperates with the cylindrical inner wall 33 to form the beaded border 26. The other partial tool 40, which serves as a coining die with an annular coining rib 21, also moves with the drawing tool 20 without, however, becoming operational initially. The container bottom receives its beaded border 26 by drawing, while the bottom itself at first retains its entirely flat surface in the position of FIG. 4B. The distance between the drawing tool 20 and the cylindrical inner wall 33 is designated 31 in FIG. 4B, and corresponds to the wall thickness of the container bottom 12 to be prepared. The drawing tool can be moved by any suitable means such as a fluid motor for example.

When the drawing tool 20 and the coining die 40 with its coining ribs 21 are moved further in the direction of the arrow A, after the drawing process, they occupy an intermediate position (FIG. 4C), wherein the container bottom 18*a*, 26 occupies a position out of the holder 23 while resting on the drawing tool 20. The drawing tool 20 is moved to a position 20*d*, wherein it cooperates with a bottom die 29, forming with the latter a clamping surface for the container bottom 12 to be formed. The beaded border 26 is secured by a sleeve-like form 28.

The bottom die 29 has a circular recess 30 corresponding to the groove 14 of the container bottom 12 to be produced. The coining rib 21 also corresponds to the shape of the groove 14, while taking into consideration the wall thickness of the container bottom 12, and is pushed into the recess 30 by any suitable means such as a fluid motor. Thus, at this location of the tool the stamping process for the circular groove 14 of the container bottom 12 is taking place. Subsequently, the drawing tool 20 and the coining die 40 are returned into their initial position in the direction of the arrow B, together with the hollow cylindrical die 19. The container bottom 12 remains at the bottom die 29, whereby it may be moved to a further processing station, usually serving to insert the container bottom 4.

It is seen in FIGS. 4A–4D that the processing steps of stamping, drawing and coining are taking place subsequent to each other during a single axial movement in the direction of the arrow A, whereby the tool is significantly simplified. That is, the die 19, the holder 23, the bottom die 29 and the form 28 are all coaxially arranged, and the tools 20, 40 travel along that axis from the position shown in FIG. 4A to that of FIG. 4D.

Although the present invention has been described in connection with a preferred embodiment thereof, it will be appreciated by those skilled in the art that modifications, substitutions, deletions, and additions may be made without departing from the spirit and scope of the invention as defined in the appended claims.

I claim:

1. In a paper container of the type which receives liquids in a hot state, the container comprising a wound paper jacket, a separate paper bottom set into said jacket, a support surface for receiving a removable cover, and a deformation area which is deformable to accommodate a reduction in volume of the closed container during cooling of the liquid, the improvement wherein said bottom having a wall thickness which is approximately one-third that of said jacket to facilitate inward deformation of said bottom, said deformation area including a circumferential groove formed in said bottom such that the portion of the bottom encompassed by said groove is inwardly deformable during cooling of the liquid to reduce the internal volume of the container by approximately 3 to 6 percent of its nominal volume.

2. In a paper container according to claim 1, characterized in that said groove is open toward the outside.

3. In a paper container according to claim 1, wherein said bottom is recessed inwardly from a lower end of said jacket.

* * * * *